US005961049A

United States Patent [19]

Kaps et al.

[11] Patent Number: 5,961,049

[45] Date of Patent: Oct. 5, 1999

[54] SHOWER SPRAY WITH ADMIXTURE OF INGREDIENTS AND AIR

[75] Inventors: Josef Kaps; Hans Kuhn, both of Hofstetten, Switzerland

[73] Assignee: Licenzia Anstalt, Vaduz, Liechtenstein

[21] Appl. No.: 08/793,902

[22] PCT Filed: Sep. 11, 1995

[86] PCT No.: PCT/CH95/00200

§ 371 Date: Mar. 12, 1997

§ 102(e) Date: Mar. 12, 1997

[87] PCT Pub. No.: WO96/08614

PCT Pub. Date: Mar. 21, 1996

[30] Foreign Application Priority Data

| | | | |
|---|---|---|---|
| Sep. 13, 1994 | [CH] | Switzerland | 2774/94 |
| Oct. 3, 1994 | [CH] | Switzerland | 2971/94 |
| Jun. 21, 1995 | [CH] | Switzerland | 1819/95 |

[51] Int. Cl.[6] ..... B05B 7/30

[52] U.S. Cl. ..... 239/307; 239/318; 239/335; 239/428.5

[58] Field of Search ..... 239/10, 61, 310, 239/311, 315, 317, 318, 307, 407, 409, 414, 425.5, 428.5, 419.5, 530, 335, 581.1, 588

[56] References Cited

U.S. PATENT DOCUMENTS

| | | | |
|---|---|---|---|
| 2,316,781 | 4/1943 | Fox et al. . | |
| 2,562,415 | 7/1951 | Chase . | |
| 2,596,387 | 5/1952 | Ellinger | 239/318 X |
| 2,743,913 | 5/1956 | Gundlach . | |
| 2,797,133 | 6/1957 | Levin | 239/311 |
| 3,231,200 | 1/1966 | Heald . | |
| 3,271,809 | 9/1966 | Morawski | 239/318 X |
| 3,720,352 | 3/1973 | Kozlowski . | |
| 3,917,172 | 11/1975 | O'Hare | 239/307 X |
| 4,019,658 | 4/1977 | Consaul . | |
| 4,200,206 | 4/1980 | Chase et al. . | |
| 4,322,036 | 3/1982 | Bly . | |
| 4,623,095 | 11/1986 | Pronk | 239/318 X |
| 4,840,311 | 6/1989 | Shamblin | 239/307 X |
| 4,901,765 | 2/1990 | Poe | 239/318 X |
| 5,071,070 | 12/1991 | Hardy . | |
| 5,135,173 | 8/1992 | Cho | 239/310 X |

FOREIGN PATENT DOCUMENTS

| | | |
|---|---|---|
| 0345231 | 2/1993 | European Pat. Off. . |
| 2396532 | 6/1978 | France . |
| 473573 | 7/1969 | Germany . |

*Primary Examiner*—Andres Kashnikow
*Assistant Examiner*—Steven J. Ganey
*Attorney, Agent, or Firm*—Selitto & Associates

[57] ABSTRACT

Provided in the shower spray, which may also be connected, as a hand-held shower with a handle piece (110'), to a flexible water hose, are two optionally activable reservoirs (150') and two storage and supply chambers (160') which are assigned to said reservoirs and are intended for receiving ingredients. By means of a venturi nozzle arranged in the shower spray, with appropriate setting, ambient air can be taken in through the ingredients and aromatized as a result. This aromatized air is admixed to the through-flowing water jet at the venturi nozzle. There is no need for any external, voluminous containers or complicated valve mechanisms. The quantity and type of the ingredients to be admixed can be set directly on the hand-held shower spray by a control lever and metering screws (170').

21 Claims, 8 Drawing Sheets

SHOWER SPRAY WITH ADMIXTURE OF INGREDIENTS AND AIR

The present invention relates to a shower spray with a venturi nozzle for the admixture of ingredients from a reservoir and ambient air to the water stream.

Nowadays, in addition to the conventional baths, showers are used widely in the private sector and in public establishments as devices for cleaning and/or massaging and therapeutic-treatment purposes. Apart from in special designs, a spray head with a large number of nozzle openings is provided, a fanned-out, finely distributed water jet emerging from this spray head. Depending on the type of nozzle openings, it is possible to draw a distinction between various showers as spray showers or rain-effect showers, fanned-stream showers or jet-stream showers. Furthermore, depending on the type of installation, it is possible to categorise the showers as fixedly arranged stand-up showers—in which case the shower head can be aligned if need be—and hand-held showers which can be moved freely on a flexible hose. It is the hand-held showers provided for spray action, in particular, which form the subject matter of the present invention. In general, a shower spray serves solely for fine, spray-like distribution of the shower water supplied.

However, shower sprays in which ingredients are admixed as washing, hair-care or body-care products—to the shower water from an externally arranged container are already known. U.S. Pat. No. 2,562,415 discloses a device in which a partial stream, which is branched off from the main-water stream before entering into the shower head, is directed through a container with bath salts and, once enriched with dissolved salts, is supplied back to the main stream. U.S. Pat. No. 2,316,781 and U.S. Pat. No. 3,231,200 describe devices with a liquid additive in the respective container, this additive being drawn off by the suction action of a venturi nozzle and admixed to the shower water. U.S. Pat. No. 3,720,352 and U.S. Pat. No. 4,200,206 disclose devices for the admixture of various liquid additives stored in a multi-chamber system, in which case, depending on valve actuation, one of the additives or a composition of a plurality of additives is admixed to the shower water. U.S. Pat. No. 4,019,658 presents a device in which the additive is taken from two aerosol cans introduced into the device. The publications mentioned above all relate to devices in which it is exclusively the additive which is admixed to the shower water.

In order to improve the mixing between the water jet and the additives, to render consumption more economical and, at the same time, to give the shower jet an invigorating tingling action, provision has been made of various devices in which, in addition to the liquid additives, a considerable quantity of air has also been supplied to the shower water. Both the additive and the air are taken in by a venturi nozzle arranged upstream of the shower head. Such devices have been disclosed by U.S. Pat. No. 2,743,913, U.S. Pat. No. 4,322,036 and U.S. Pat. No. 5,071,070, the latter publication involving a multi-chamber system. The common feature of all these devices is that they require one or more containers arranged externally to the shower spray for the purpose of storing the additives, and thus it is only stand-up showers which are actually suitable for being fitted out in such a manner. Activation of the admixture operation is somewhat complicated since it is necessary to actuate the mechanism of the admixture device separately from the cold-water and hot-water valves or the combination valve, and at some distance from the latter. In addition, the relatively voluminous containers for the additives do not always lend themselves to aesthetically pleasing integration in an, at best, only medium-sized bathroom. Moreover—as a result of the additive being flushed directly into the shower jet—an effective distribution of fragrance is only possible with a substantial admixture of the additive, but this causes not inconsiderable contamination of the waste water. Finally, the abovementioned devices cause a considerable amount of trouble from time to time when being cleaned.

CH-A-473 573 discloses a hand-held shower spray which is intended for the admixture of ingredients and air into the water stream and likewise functions in accordance with the venturi principle. Provided directly in the hand-held shower spray is a cavity, which is used as a reservoir, for the storage of the ingredient to be admixed to the water. Coming from the reservoir, a tube projects into the duct for the water stream and, closer to the shower head, air-inlet openings are arranged in the duct. A switching movement releases both the tube for the admixture of the ingredient and the air-inlet openings, with the result that the flowing water takes in, first of all via the tube, a fine jet of ingredient and, upstream of the shower head, air. Although this device does indeed solve the problem of storing the ingredient directly in the hand-held part of the shower spray, the ratio of the distribution of fragrance to the proportion of admixed ingredient used is still unfavorable.

CH-A-473 573 discloses a hand-held shower spray which is intended for the admixture of ingredients and air into the water stream and likewise functions in accordance with the venturi principle. Provided directly in the hand-held shower spray is a cavity, which is used as a reservoir, for the storage of the ingredient to be admixed to the water. Coming from the reservoir, a tube projects into the duct for the water stream and, closer to the shower head, air-inlet openings are arranged in the duct. A switching movement releases both the tube for the admixture of the ingredient and the air-inlet openings, with the result that the flowing water takes in, first of all via the tube, a fine jet of ingredient and, upstream of the shower head, air. Although this device does indeed solve the problem of storing the ingredient directly in the hand-held part of the shower spray, the ratio of the distribution of fragrance to the proportion of admixed ingredient used is still unfavourable.

To summarize then, all that need be said is that the hitherto developed devices on shower sprays for the admixture of ingredients and air cannot as yet be regarded as optimum in terms of their efficiency and handling capacity. The object of the present invention is thus to provide an improved shower spray with an admixture device which, using a small quantity of a substance which is to be added, causes the latter to be mixed completely with the air-permeated spray jet and causes the surroundings thereof to be aromatized well. The shower spray is to be designed, in particular, as a hand-held shower which can be operated simply and is to manage without voluminous, external containers for the purpose of storing the ingredients. In an extended variant of the device, the intention is for it to be possible to make a selection at least between two different ingredients to be admixed and a zero position, in which no admixture takes place. It is not only the actual usage of the shower spray which is to be rendered user-friendly, but also the initial installation of said spray, the operation of filling the spray with the ingredients, and the upkeep of the spray.

The essence of the invention is that the ingredients are stored in a reservoir, which is provided directly in the shower spray, and air is taken in, by a venturi nozzle, through these ingredients and, aromatized in this manner, is admixed to the shower water. Two separate reservoirs are preferably provided in the shower spray, and it is possible to activate one reservoir or the other, or the zero position, by means of a selector switch. In a second embodiment, each reservoir is assigned a storage and supply chamber, and the rate at which ingredients are supplied into the reservoirs is set by means of metering screws. The advantages of the shower spray according to the invention reside predominantly in the high efficiency, the capacity for universal use, the problem-free installation and the ability to be handled practically. Neither voluminous containers nor complicated valve mechanisms are required, and the desired function can be set directly on the hand-held shower spray. The ingredient particles which are distributed finely in the shower water reach the parts of the body on which the shower is being used and, depending on the product selected, a revitalising or relaxing atmosphere is simultaneously produced in the surroundings of the person who is taking the shower.

The shower spray according to the invention is described in more detail hereinbelow with reference to the accompanying drawings, in which FIGS. 1 to 6*b* show a first embodiment and FIGS. 7 to 7*d* show a second embodiment, to be precise:

Figures 1, 2:
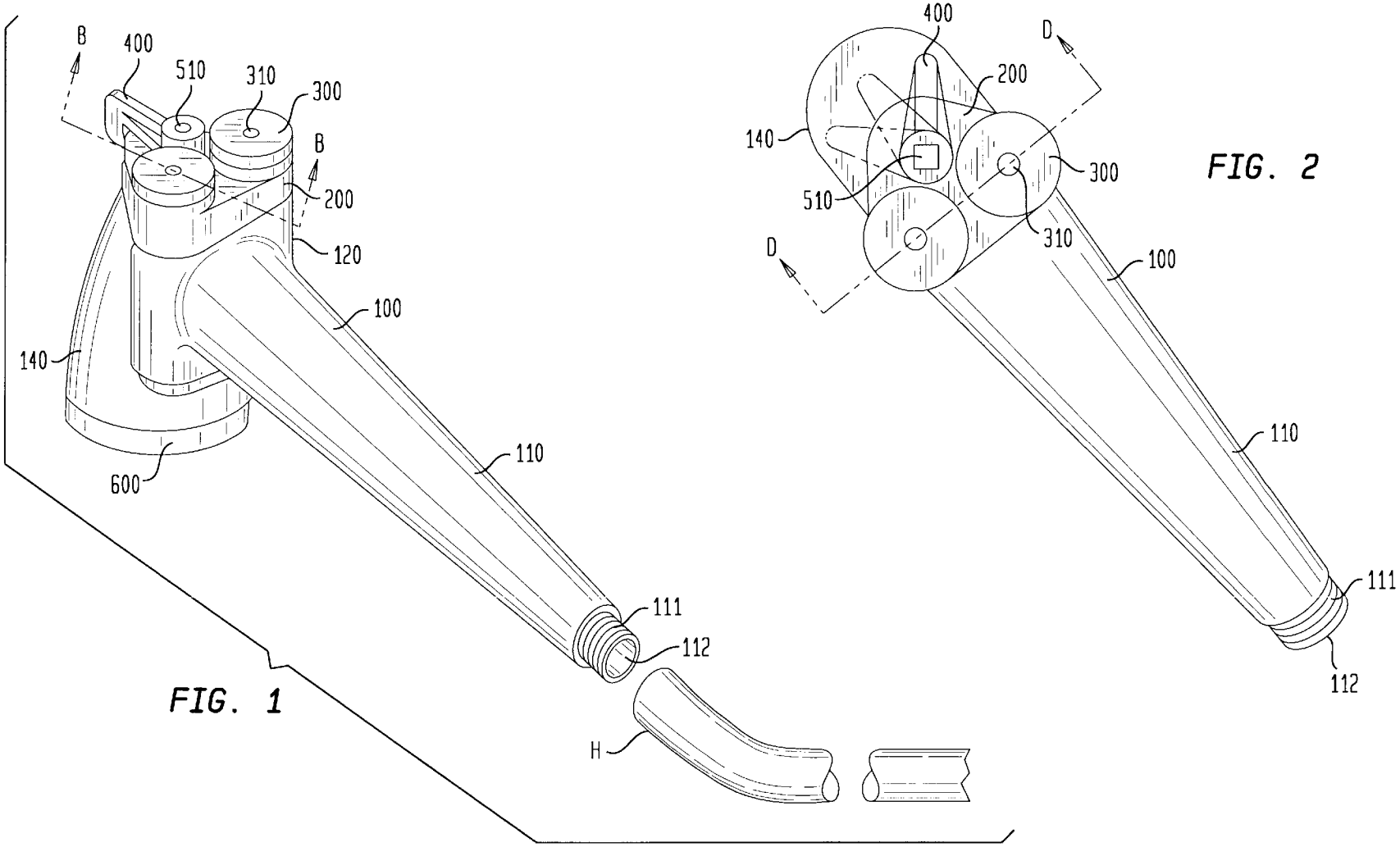
FIG. 1 shows a perspective illustration of the shower spray.
FIG. 2 shows the plan view of the shower spray according to FIG. 1.
Figure 2A:
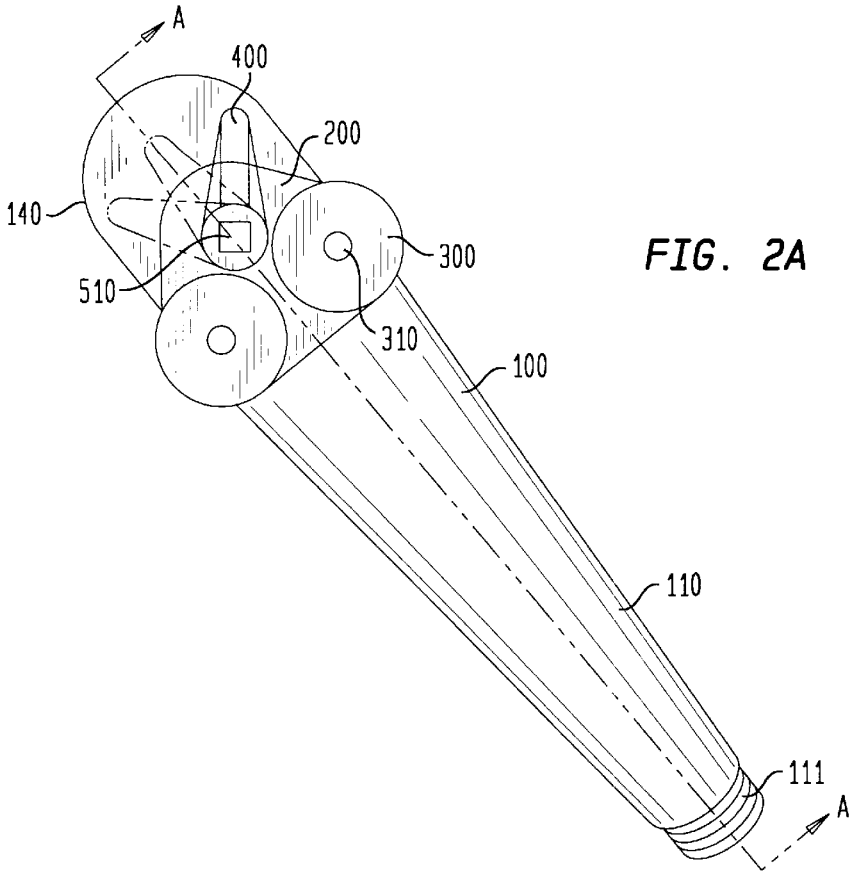
Figure 2B:
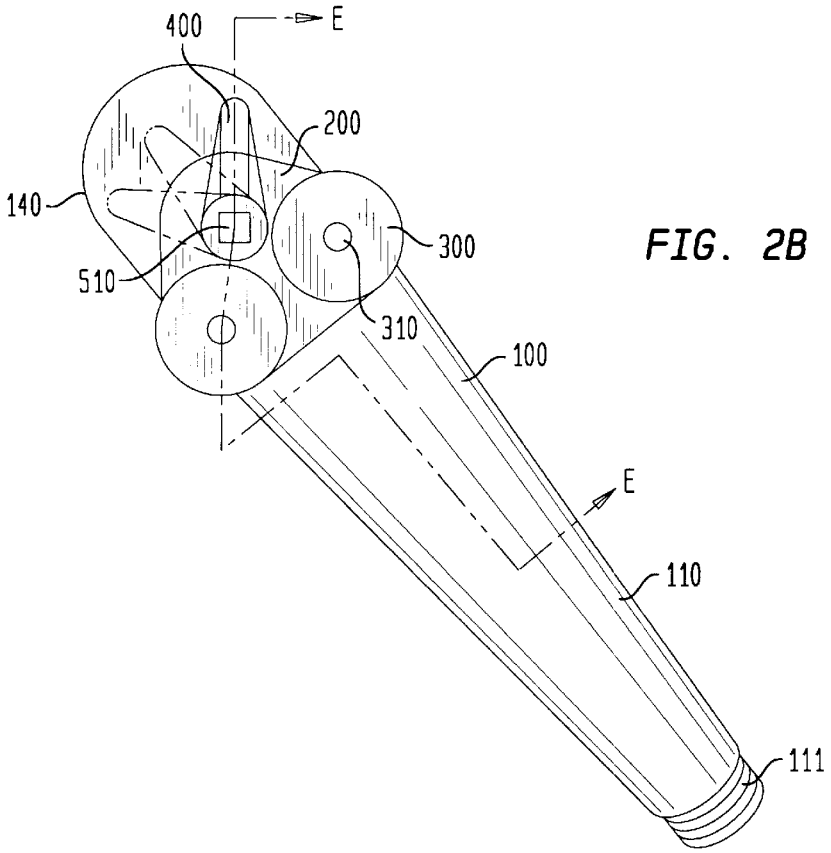
Figure 3:
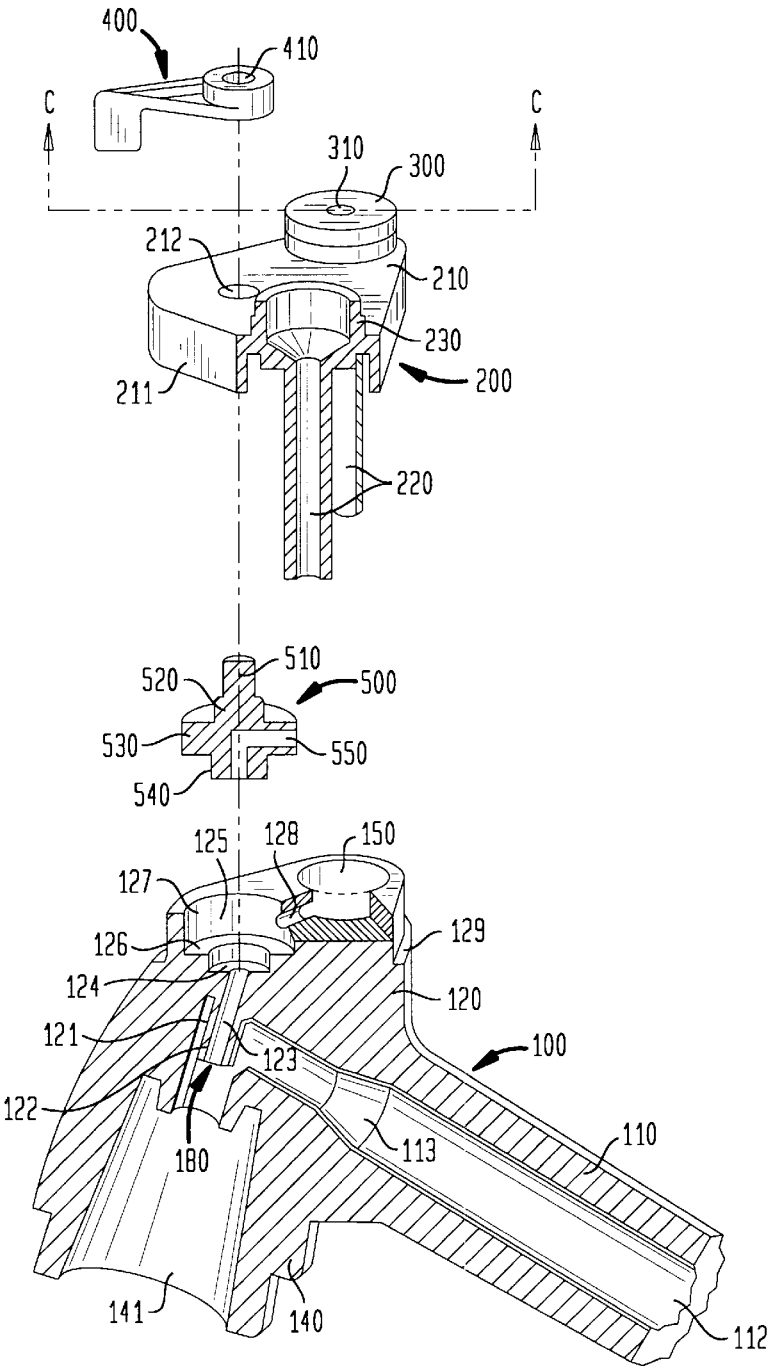
Figure 3A:
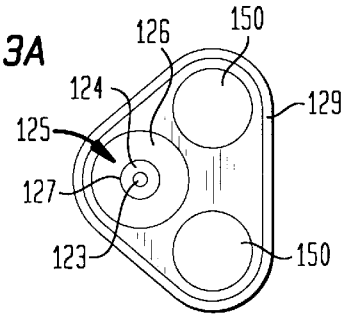
Figure 4:
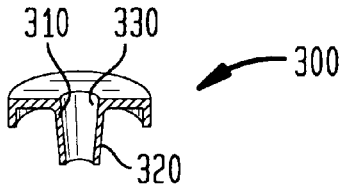
Figure 5:
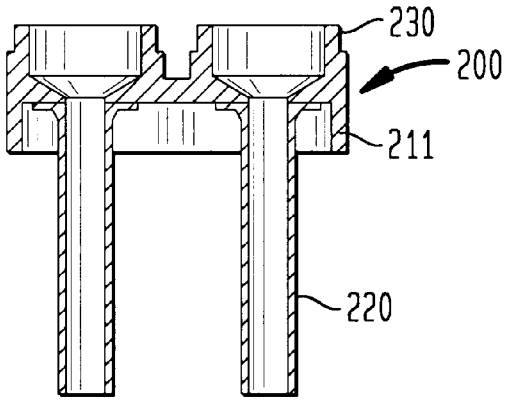
Figure 5A:
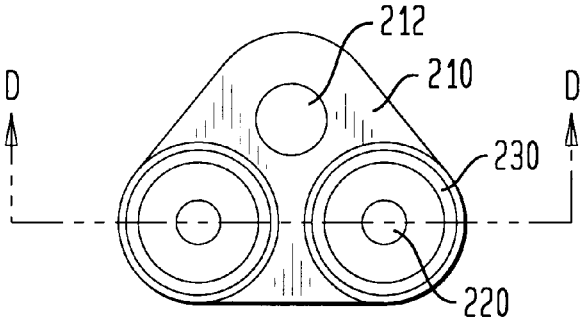
Figure 6:
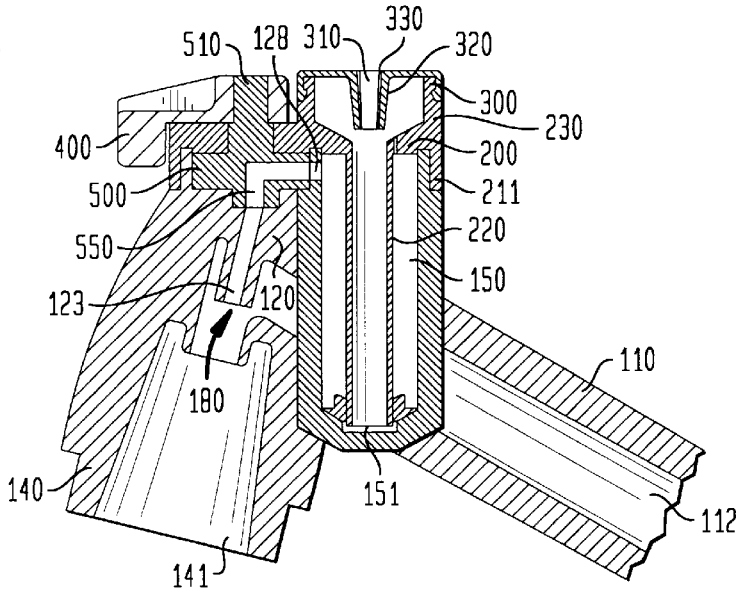
Figure 6A:
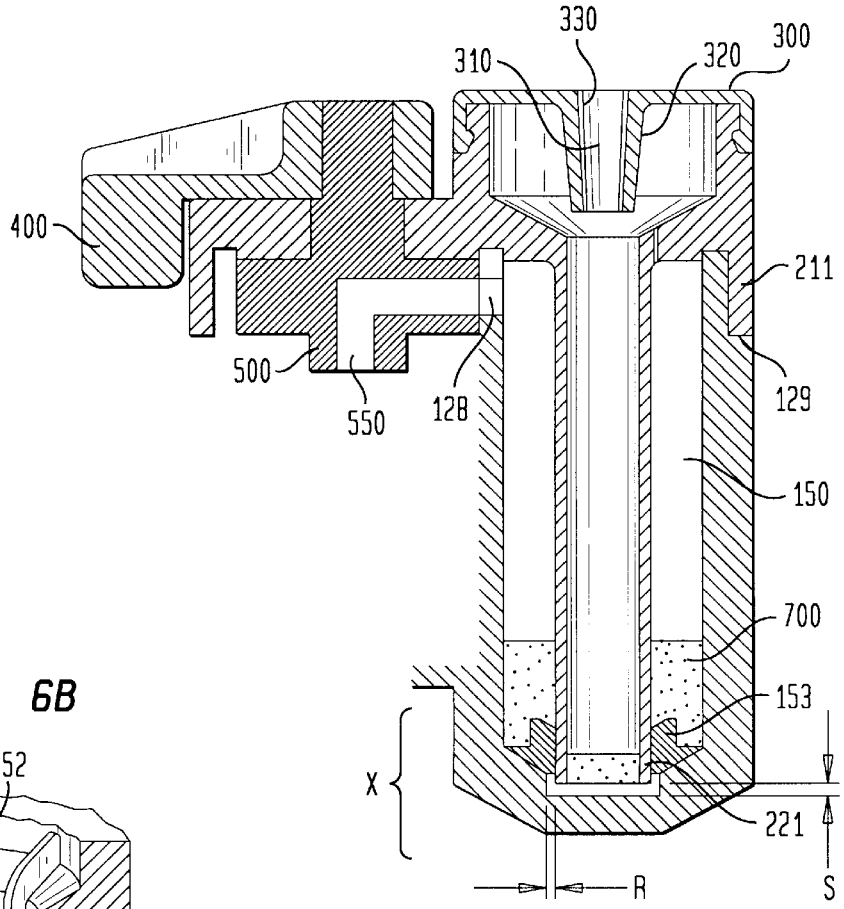
Figure 6B:
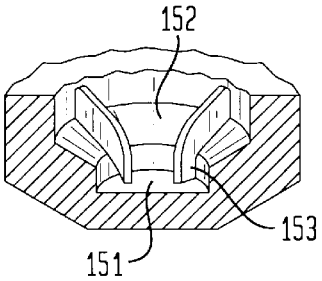

FIG. 2*a* shows the illustration according to FIG. 2 with the section plane A—A included therein;

FIG. 2*b* shows the illustration according to FIG. 2 with the section plane E—E included therein;

FIG. 3 shows an exploded illustration of the shower spray in partial sections, with the basic body in the section A—A according to FIG. 2*a,* and with the reservoir insert in section B—B according to FIG. 1, and with the associated activating part and the control lever;

FIG. 3*a* shows the plan view of the basic body according to FIG. 3 (not in section) in the region of the two reservoirs and of the recess for the activating part;

FIG. 4 shows a cap of the reservoir insert in section C—C according to FIG. 3;

FIG. 5 shows the reservoir insert in the section D—D according to FIGS. 2 and 5*a* without caps;

FIG. 5*a* shows the plan view of the reservoir insert according to FIG. 5;

FIG. 6 shows the section E—E according to FIG. 2*b* with the shower head;

FIG. 6*a* shows an enlargement of the section E—E according to FIG. 2*b* without the shower head;

FIG. 6*b* shows the detail X from FIG. 6*a;*

Figure 7:
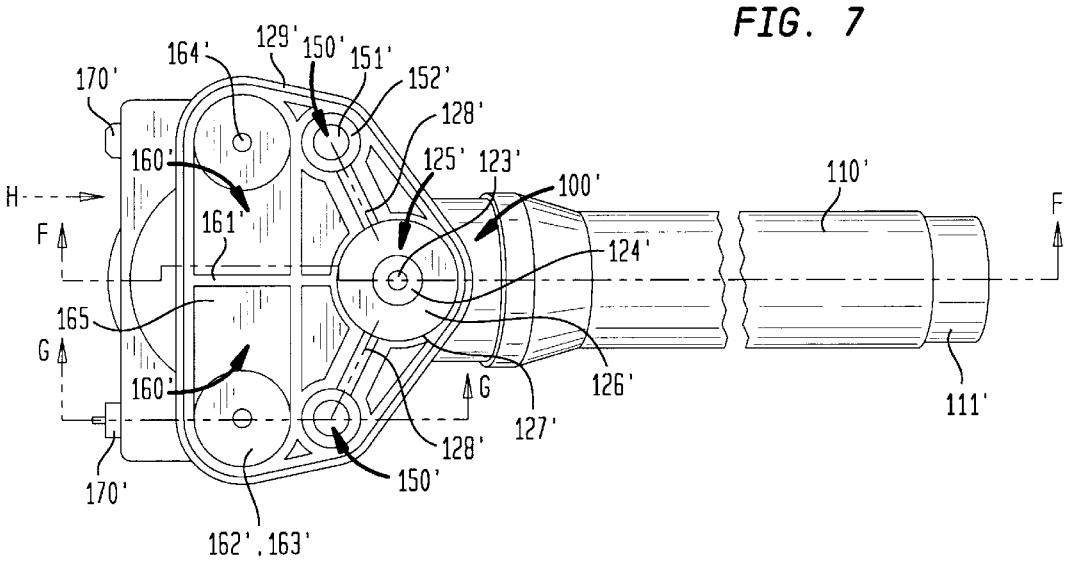
Figure 7A:
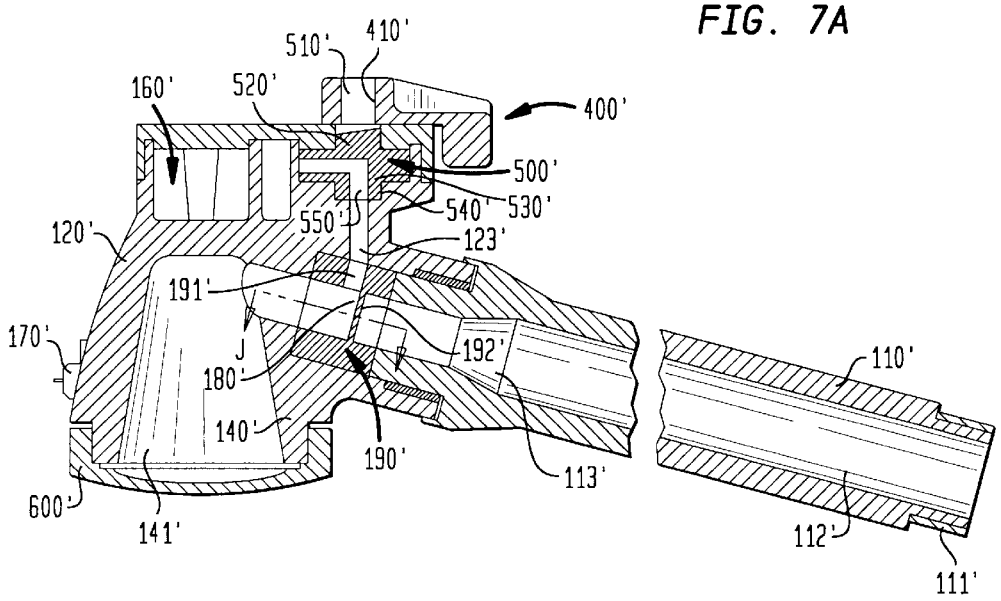
Figure 7B:
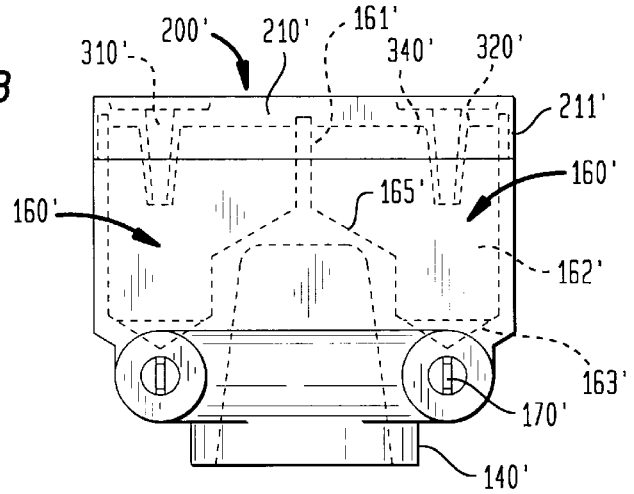
Figure 7C:
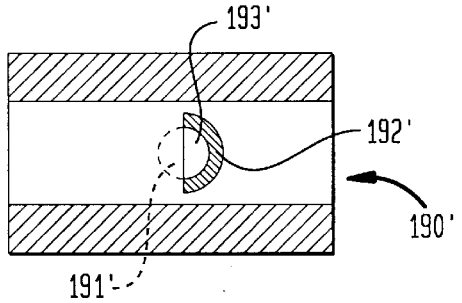

FIG. 7 shows a plan view of a second embodiment of the present invention, including the basic body with storage and supply chambers assigned to the reservoirs and with metering screws, but without reservoir insert, control lever and activating part;

FIG. 7*a* shows the section F—F according to FIG. 7, but with reservoir insert, control lever and activating part;

FIG. 7*b* shows the view according to the directional arrow H in FIG. 7, but without the shower-head insert;

FIG. 7*c* shows the section J—J through the nozzle element from FIG. 7*a;*

Figure 8:
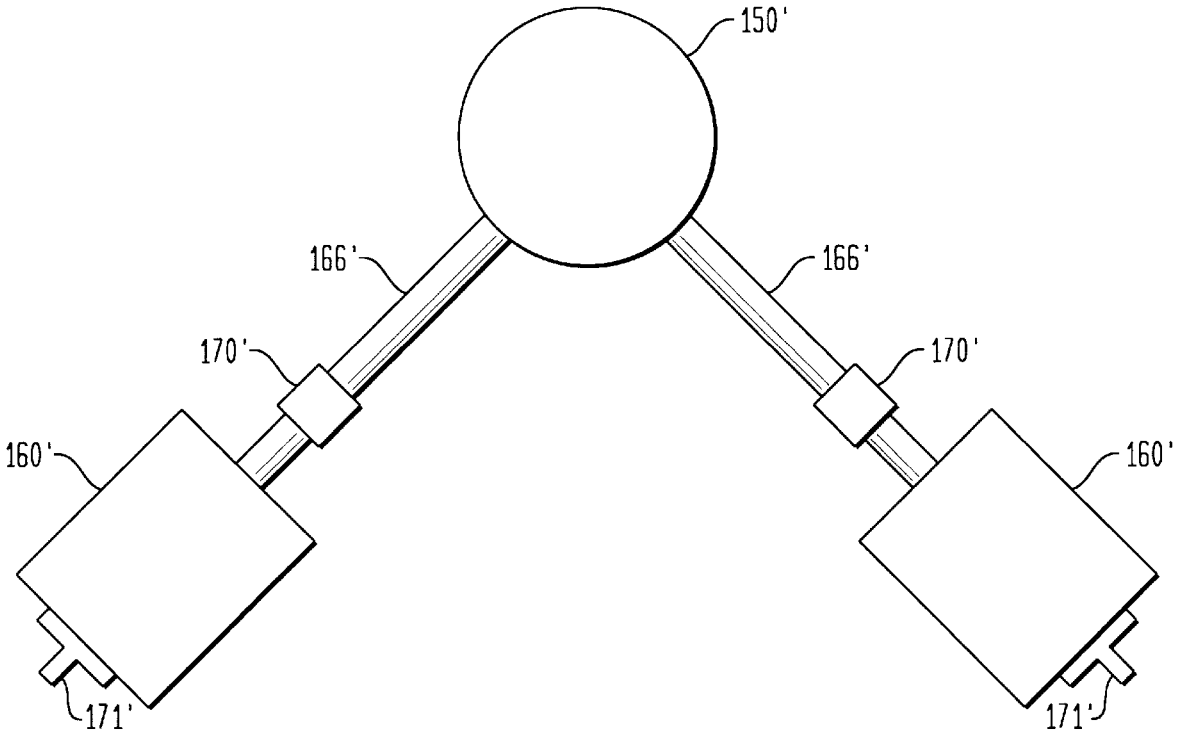

7*d* shows the section G—G according to FIG. 7, but without the shower-head insert; and FIG. 8 shows a schematic diagram of a third embodiment of the present invention.

FIG. 1

The shower spray, in complete form, comprises the basic body 100, the reservoir insert 200, the caps 300, the control lever 400, the activating part 500 (see FIG. 3) and the shower-head insert 600. The basic body 100 is made up of the handle piece 110, the central part 120 and the head part 140. The handle piece 110 has an external thread 111 right at the back, for connection to a spray hose H, and a through-passage bore 112 for the through-passage of water. The handle piece 110 is adjoined by the central part 120 which, for its part, emerges into the downwardly directed head part 140. Right at the bottom, the conventionally screen-like shower-head insert 600 is arranged on the outlet of the head part 140.

The two-tube reservoir insert 200 is positioned on the central part 120 and pushed into the latter. The reservoir insert 200 is provided with two identical caps 300, which have an opening 310 right at the top. Symmetrically with respect to the two caps 300 and in the vicinity of the tip of the reservoir 200, the control lever 400 is positioned on the slightly projecting shaped piece 510 of the activating part 500. The control lever 400 has an inner contour which is complementary to the outer contour of the pin 510, with the result that, when the control lever 400 is rotated, the activating part 500 is moved along therewith. The control lever 400 can be adjusted into three positions. In this figure, it is located in the central, zero position, i.e., at this moment in time, it is not possible for air enriched with ingredients to be taken in, and admixed to the shower jet, via any of the reservoirs.

The following statement applies for the rest of the description in its entirety. If reference numerals are contained in a figure for the purpose of clarifying the drawing but are not explained in the directly related text of the description, then you should refer to prior descriptions of the figures which mention them.

FIG. 2

In this figure, the control lever 400 has been adjusted to the front reservoir, which is directed towards the viewer, i.e.—provided that water is flowing through the shower spray at sufficient rate—air enriched with ingredients is taken in, and admixed to the shower jet, via this reservoir. If the control lever 400 were pivoted around out of this end position, via the central, zero position, to the second reservoir, aromatized air would be taken in for admixture purposes from the latter reservoir.

FIGS. 2*a* and 2*b*

These figures serve solely for an explanation and understanding of the drawings. Thus, the section plane A—A which runs axially and vertically through the shower spray is depicted in FIG. 2*a*. FIG. 2*b* includes the section plane E—E, which initially coincides with the section A—A but then runs diagonally, from the outside, through the central part 120, the reservoir insert 200 and the control lever 400.

FIGS. 3 to 5*a*

The basic body 100, which has been cut open, is illustrated right at the bottom in the main FIG. 3, it being possible to see only the start of the handle piece 110. The through-passage bore 112 extends axially through the handle piece 110 into the central part 120 and, in this case, bends downwards in a bent section 121 and merges into the enlarged, conically downwardly opening outlet bore 141. Coming from the top, a tube piece 122 projects into the bent section 121 and has a duct 123 running through it, said duct opening out in the base 124 of the recess 125 provided for the activating part 500. Moving upwards, the recess 125 widens at an offset section, this producing an annular seat surface 126. The lateral surface 127 rises from the periphery of the seat surface 126. From the lateral surface 127, in each case one duct 128 extends to the first and second reservoirs 150, which duct will be described at a later stage in the text. In the region of the bent section 121, the incoming through-passage bore 112, which has previously been reduced in cross-section at the narrowed section 113, and the tube piece 122 with the duct 123 form a venturi nozzle 180.

The top section of the central part 120 is basically triangular in plan view, the corners being rounded. The access for the two downwardly extending reservoirs 150 is located in the region of in each case one corner, and the recess 125 is made in the region of the third corner, which is oriented towards the front. A sunken shoulder 129 runs around the outside of the top section of the central part 120.

The geometry of the activating part 500 is complementary to the recess 125, with the result that said activating part 500 can be introduced into, and rotated in, this recess. The activating part 500 comprises the pin 510, which is arranged right at the top, the thickened bearing part 520, located therebeneath, the adjoining disc segment 530 of further-enlarged diameter and, right at the bottom, the reduced-diameter connection part 540. A duct 550 runs to the periphery of the disc segment 530 from the underside of the connection part 540.

If the activating part 500 is introduced into the recess 125, then the connection part 540 is positioned on the base 124, the duct 123 adjoining the duct 550, and the disc segment 530 is positioned on the seat surface 126. The bearing part 520 and the pin 510 project out of the recess 125. In the respective end position of the control lever 400, the duct 550, which emerges on the periphery of the disc segment 530, opens out at the duct 128 belonging to the first or to the second reservoir 150. In the zero position of the control lever 400, the duct 550, which emerges on the periphery of the disc segment 530, is closed by the lateral surface 127.

The reservoir insert 200 comprises the cover 210 with the surround 211, two directing tubes 220 each extending downwards from a corner region of the cover 210, and the filler stubs 230 which project beyond the cover 210, are widened in the manner of funnels and have the directing tubes 220 starting at their bases. A through-passage bore 212 is provided in the third corner region of the cover 210. The two filler stubs 230 are each closed by a cap 300 which has an opening 310 at the top.

If the reservoir insert 200 is plugged onto the basic body 100, then the cover 210 is located at the top on the central part 120, and the surround 211 is positioned on the shoulder 129. The directing tubes 220 are plugged into the reservoirs 150 and the bearing part 520 is guided in the through-passage bore 212, the pin 510 projecting beyond the cover 210, with the result that the control lever 400 may be positioned thereon. The control lever 400 has a recess 410 which is sufficient for the purpose of receiving the pin 510. A short inlet tube 320, in which a plurality of spacer webs 330 are provided, extends downwards from the opening 310 of the cap 300. The function of the spacer webs 330 in the caps 300 is to ensure that air escapes when ingredients are refilled into the reservoirs 150.

FIG. 6

The assembled shower spray is shown in this specific sectional illustration, the control lever 400 being positioned such that there is a connection between the ducts 123, 550 and 128 and the front reservoir 150. A reservoir 150 is basically formed from a deep blind bore in the central part 120 of the basic body 100. The directing tube 220, introduced into the reservoir 150, of the reservoir inset 200 which has been placed in position terminates just before the reservoir base 151.

FIGS. 6*a* and 6*b*

The gaps between the reservoir base 151 and the directing tube 220 which has been pushed into the reservoir 150 will now be described with reference to these figures. Provided in the vicinity of the reservoir base 151 is a step-like offset section 152, by way of which the diameter of the reservoir 150 narrows abruptly. A plurality of centering webs 153 which reach as far as the reservoir base 151 are arranged on the offset section 152. The directing-tube end piece 221, which penetrates into this region, leaves a flow gap S towards the reservoir base 151. The centering webs 153 cause the directing-tube end piece 221 to be aligned centrally, with result that a defined, uniform, lateral annular gap R also remains. The flow gap S and the annular gap R are determined in accordance with the viscosity of the ingredients 700 introduced.

The shower spray functions as follows, it being assumed that the control lever 400 is located in one of the two end positions and that a reservoir 150 is thus activated. As the supply valve is opened, water begins to flow through the shower spray and venturi nozzle 180 causes a negative pressure, something of a suction action, in the duct 123, which continues into the activated reservoir via the ducts 550 and 128. As a result of the negative pressure in the reservoir 150, ambient air is taken in through the opening 310 in the cap 300, flows downwards through the directing tube 220, flows around the directing-tube end 221 and thereby passes the flow gap S and the annular gap R and ultimately flows, via the ducts 128, 550 and 123, to the venturi nozzle 180 and is admixed there to the shower water. Since the reservoir 150 is at least partially filled with a certain ingredient, the air which is taken in has to pass through the ingredient. In the process, the air picks up particles of substance and is aromatized correspondingly. As a result, a water jet which is mixed with aromatized air and contains the ingredient in finely distributed form flows out of the shower spray.

If it is desired to break off the admixture operation, all that is required is to move the control lever 400 into the zero position. If the intention is to admix the ingredient from the second reservoir 150, the control lever 400 has to be moved into the other end position.

Figure 7D:
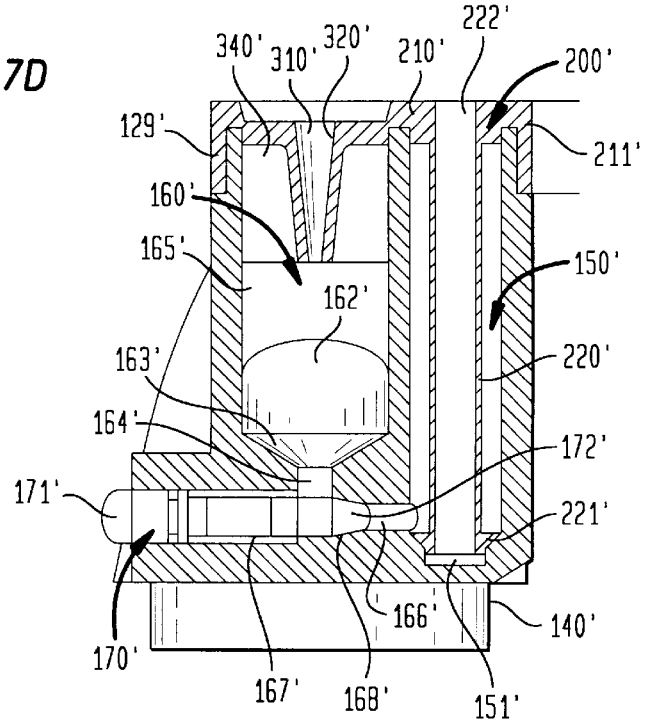

FIGS. 7 to 7*d*

The special features of the second embodiment, which is now to be discussed, are that each reservoir is assigned a storage and supply chamber and the rate at which the ingredients are supplied into the reservoirs is set by means of metering screws. Furthermore, the configuration of the shower spray in the region of the venturi nozzle differs from that of the first embodiment.

The shower spray once again comprises a basic body 100' with a handle piece 110', a central part 120' and a head part 140', it being favourable from a production point of view to produce the handle piece 110' separately and to fit it onto the basic body 100'. An external thread 111' is located at the end of the handle piece 110' for the purpose of connecting the water-supplying hose. The through-passage bore 112' with the narrowed section 113' extends through the handle piece 110'. The central part 120' likewise has a shoulder 129' running around it at the top. In alignment with the handle piece 110', the recess 125' for receiving the activating part 500' is provided in the central part 120'. The recess 125' also has a lateral surface 127', a seat surface 126', a base 124' and a duct 123' which leads downwards to the venturi nozzle 180'.

The activating part 500' and the control lever 400' are identical to the activating part 500 and the control lever 400.

The respective details are provided with the corresponding reference numerals. Two mirror-symmetrical ducts 128' extend tangentially from the recess 125', in the form of arms, towards the two reservoirs 150'. With an appropriate switching position, the duct 550' provided in the activating part 500' connects the duct 123', coming from the water stream, to one of the ducts 128', which leads to one of the two reservoirs 150'. According to FIG. 7*a,* the control lever 400' is located in the zero position, in which said lever is aligned with the handle piece 110'; this means that, at this moment in time, there is no through-passage from the duct 123' to one of the reservoirs 150'.

Arranged upstream of the two reservoirs 150', as seen in the direction of the end side of the central part 120', are two identical, large-volume storage and supply chambers 160', which are separated from one another by a central wall 161'. Each storage and supply chamber 160' has a bottom, cylindrical, blind-hole-like depression 162' which narrows downwards in the manner of a funnel and has a downwardly oriented discharge bore 164' at the base 163'. Moving upwards, the depression 162' widens at a sloping section 165', which runs towards the central wall 161'. One metering screw 170', which can be screwed into the head part 140', is provided for each reservoir 150' and associated storage and supply chamber 160'. In the complete state, a shower-head insert 600' is positioned on the downwardly oriented outlet bore 141' provided in the head part 140'.

A reservoir insert 200' is positioned on the central part 120' from the top and, in the case of single-piece design, which is advantageous from a production point of view, simultaneously functions as a cap. Accordingly, the reservoir insert 200' comprises a cover 210' with a surround 211' which is positioned on the shoulder 129' of the central part 120'. A through-passage bore 212' is provided in the cover 210' for the through-passage of the pin 510' of the activating part 500'. Running in the downwardly directed direction from the cover 210' are two directing tubes 220' and two inlet tubes 320', which are arranged in a complementary manner to the positions of the reservoirs 150' and of the storage and supply chambers 160'. The directing tubes 220' open out in the cover 210' by way of their openings 222' and the inlet tubes 320' open out in the cover 210' by way of their openings 310'.

With the reservoir insert 200' placed in position, the directing tubes 220' are plugged into the two reservoirs 150', while the inlet tubes 320' project into the storage and supply chambers 160'. Located in the cover 210' beside the inlet tubes 320' is at least in each case one air-compensation hole 340', from which it is possible for the air which is displaced through the inlet tubes 320' during introduction of ingredients 700 to escape. The single-part reservoir insert 200', which is designed simultaneously as a complete cover, renders superfluous separate caps 300 according to FIG. 4.

The specific design between the reservoir bases 151' and the directing-tube ends 221' of the directing tubes 220' plugged into the reservoirs 150' correspond to the explanation for FIGS. 6 to 6*b*.

Introduced downstream of the narrowed section 113' located in a through-passage bore 112' of the handle piece 110', as seen in the flow direction, is a nozzle element 190' which has a duct 191', which adjoins the duct 123' provided in the central part 120'. Immediately upstream of the point at which the duct 191' opens out in the narrowed through-passage bore 112', a flow-directing element 192' in the form of the arc of a semicircle is positioned vertically in the flow path, and the duct 191' is directed towards the U-opening 193' thereof (see FIG. 7*c*). This arrangement, even in the case of a low flow rate, assists the development of the negative pressure in the duct 191', which continues, via the ducts 123', 128' and 550', into the reservoir 150' and the storage and supply chamber 160'.

The metering screws 170' (see, in particular FIG. 7*d*) serve to regulate the supply of ingredients from the storage and supply chambers 160' into the reservoirs 150'. The separate storage and supply chambers 160', additionally arranged beside the reservoirs 150', reduce the consumption of ingredients and thus render individual filling more economical. The respective reservoir 150' and the associated storage and supply chamber 160' are adjacent to one another. The discharge bore 164' extending vertically downwards from the base 163' of the storage and supply chamber 160' branches off at right angles and continues as a horizontal supply bore 166' and opens out in the bottom region of the reservoir 150'. Towards the outside, i.e. in the direction of the end side of the head part 140', the supply bore 166' is lengthened in the form of a threaded bore 167'. At the point of transition from discharge bore 164' and threaded bore 167' to the supply bore 166', the latter has a cone seat 168'.

The metering screw 170' is introduced into the threaded bore 167' and its grip element 171' can be grasped from the outside for the purpose of rotating the metering screw 170', and its cone point 172'—depending on the depth setting—penetrates in to the cone seat 168'. With an increasing depth setting, i.e. as the metering screw 170' is screwed in to an increasing extent, the gap remaining between the cone point 172' and the cone seat 168' decreases, as a result of which the throughflow rate of ingredients decreases. In the foremost end position, the cone seat 168' is completely closed, with result that it is no longer possible for any ingredients to flow into the reservoir 150' from the storage and supply chamber 160'. Ingredients are supplied into the reservoir 150' from the storage and supply chamber 160' by the pressure of the liquid column in the storage and supply chamber 160' and by the negative pressure produced at the venturi nozzle 180' when water flows through the shower spray.

The function of the control lever 400' and of the aromatization operation in the reservoirs 150' corresponds to the description for the first embodiment. In the first embodiment, the air which is mixed in the water stream is taken in via the openings 310 in the caps 300; in the second embodiment, by contrast, the air is taken in via the directing-tube openings 222' and additionally, to a minimal extent, via the air-compensation holes 340' in the cover 210'.

Further design variations of the abovedescribed shower spray may be realized. The following should be mentioned in particular:

- it is conceivable for only a single reservoir 150, or possibly even three such reservoirs 150, to be provided in the shower spray, in which cases it would be necessary to adapt the series of ducts and the switching positions of the control lever 400 correspondingly.
- instead of liquid ingredients, it is also suitable to use an absorbent, impregnated insert in the reservoirs 150, in which case the air which has been taken in passes through said insert.

The single-part reservoir insert 200' could also be combined with separate caps 300 again.

The second embodiment of the shower spray as shown in FIGS. 7 to 7*d,* with two reservoirs 150' and two storage and supply chambers 160', may be simplified in that the two storage and supply chambers 160' are only assigned one, common reservoir 150' as shown in FIG. 8. In the third embodiment, the control lever 400' and the activating part 500' may be dispensed with. Referring now to FIG. 8, the supply of ingredients from one of the storage and supply chambers 160' is blocked by means of the associated metering screw 170', while the other storage and supply chamber 160' has its associated metering screw 170' partially or wholly open. Appropriate setting of the metering screws 170' can break off the supply of ingredients completely or permit a mixing operation.

We claim:

1. A shower spray device, comprising:

a body including a handle piece, a central part, and a head part;

at least two reservoirs provided in said central part, each reservoir having an associated storage and supply chamber connected thereto, for supplying the associated reservoir with an ingredient;

a venturi nozzle;

a series of ducts connecting said venturi nozzle to each of said at least two reservoirs, said series of ducts including a connecting duct and being configured such that air is taken through the ingredient and is mixed with particles of the ingredient; and switching means, including an activating part integrated in said central part, for switching said connecting duct between a first position, in which said connecting duct connects said venturi nozzle to one of said at least two reservoirs, and a second position, in which said connecting duct does not connect said venturi nozzle to any of said at least two reservoirs, whereby the air and ingredient mixture from said at least two reservoirs can be selectively admixed to a water stream flowing through said shower spray device.

2. A shower spray device according to claim 1, wherein said shower spray device is configured as a hand-held spray device which can be connected to a flexible water hose.

3. A shower spray device according to claim 1, wherein:

said central part includes a reservoir insert having a cover and a through-passage bore extending through said cover;

said activating part is rotatably arranged in a recess accessible from an upper side of said central part and includes a pin extending through said through-passage bore, said pin including a control lever mounted thereon; and said connecting duct extends through said activating part.

4. A shower spray device according to claim 1, further comprising a first supply bore connecting one of said at least two reservoirs to the associated storage and supply chamber;

a second supply bore connecting another of said at least two reservoirs to the associated storage and supply chamber;

a first metering screw located in said first supply bore for controlling the amount of ingredient supplied from said one reservoir to the associated storage and supply chamber; and a second metering screw located in said second supply bore for controlling the amount of ingredient supplied from said another reservoir to the associated storage and supply chamber.

5. A shower spray device, comprising:

a body including a handle piece, a central part, and a head part;

a reservoir provided in said central part, said reservoir having a first storage and supply chamber connected thereto by a first supply bore, for supplying said reservoir with an ingredient, and a second storage and supply chamber connected thereto by a second supply bore, for supplying said reservoir with an ingredient;

a venturi nozzle;

a series of ducts connecting said venturi nozzle to said reservoir, said series of ducts being configured such that air is taken through the ingredient and is mixed with particles of the ingredient; and controlling means for controlling the amount of ingredient supplied from said first and second storage and supply chambers to said reservoir, said controlling means including a first metering screw located in said first supply bore and a second metering screw located in said second supply bore, whereby the air and ingredient mixture from said first and said second storage and supply chambers can be selectively added to a water stream flowing through said shower spray device.

6. A shower spray device according to claim 5, wherein said shower spray device is configured as a hand-held spray device which can be connected to a flexible water hose.

7. A shower spray device, comprising:

a body including a central part;

a reservoir provided in said central part, said reservoir having a storage and supply chamber connected thereto for supplying said reservoir with an ingredient, and said reservoir including a blind bore in said central part, a reservoir base, a step-like offset section adjacent to said reservoir base and extending around an inner circumference of said reservoir, and radial centering webs arranged perpendicularly to said offset section and adjacent to said reservoir base;

a venturi nozzle;

a series of ducts connecting said venturi nozzle to said reservoir and being configured such that air is taken through the ingredient and is mixed with particles of the ingredient;

a reservoir insert mounted on said central part; and a directing tube extending from said reservoir insert into said reservoir and toward said reservoir base, an end of said directing tube being fixed in said reservoir by said centering webs, said centering webs cooperating with said directing tube to create a flow gap between said reservoir base and said directing tube and to create an annular gap between said directing tube and a reservoir wall, said reservoir being connected to the atmosphere solely by way of said directing tube, whereby the air and ingredient mixture from said reservoir can be admixed to a water stream flowing through said shower spray device.

8. A shower spray device according to claim 7, wherein said shower spray device is configured as a hand-held spray device which can be connected to a flexible water hose.

9. A shower spray device according to claim 7, wherein:

said reservoir insert includes a cover having a surround and a through-passage bore, said surround being positioned on a shoulder which extends around said central part; and said directing tube has a directing tube opening in said cover which opens to the atmosphere.

10. A shower spray device according to claim 9, further comprising:

an activating part having a pin which extends through said through-passage bore;

an inlet tube extending downwards from said cover into said storage and supply chamber, said inlet tube having an opening in said cover which opens to the atmosphere; and an air-compensation hole provided in said cover, said air-compensation hole positioned above said storage and supply chamber.

11. A shower spray device, comprising:

a handle piece including an axial through-passage bore extending therethrough, said through-passage bore including a narrowed section;

a reservoir having a storage and supply chamber connected thereto for supplying said reservoir with ingredient;

a venturi nozzle;

a series of ducts connecting said venturi nozzle to said reservoir, said series of ducts including a first duct and a second duct and being configured such that air is taken through the ingredient and is mixed with particles of the ingredient; and a nozzle element positioned downstream of said narrowed section and upstream of an opening of said first duct, said nozzle element and said opening of said first duct forming said venturi nozzle, said nozzle element including a semicircular flow directing element and said second duct, said flow directing element including a channel-like opening oriented in a downstream direction, said second duct merging into said first duct at one end thereof and opening axially into said channel-like opening at another end thereof, whereby the air and ingredient mixture from said reservoir can be admixed to a water stream flowing through said shower spray device.

12. A shower spray device, comprising:

a body, including a head part;

a reservoir having a storage and supply chamber connected thereto for supplying said reservoir with ingredient, said storage and supply chamber including a base, a discharge bore extending from said base and merging into a supply bore opening into said reservoir, and a threaded bore extending from said supply bore towards an end side of said head part, said supply bore including an inlet having a cone seat sized and shaped to receive a cone point of a metering screw;

a venturi nozzle; and a series of ducts connecting said venturi nozzle to said reservoir and being configured such that air is taken through the ingredient and is mixed with particles of the ingredient, whereby the air and ingredient mixture from said reservoir can be admixed to a water stream flowing through said shower spray device.

13. A shower spray device, comprising:

a body including a handle piece, a central part, and a head part, said central part located adjacent to said head part;

first storage means and second storage means located internally of said central part, for storing an ingredient;

a venturi nozzle;

a series of ducts connecting said venturi nozzle to said first and said second storage means, said series of ducts including a connecting duct and being configured such that air is taken through the ingredient and is mixed with particles of the ingredient; and switching means for switching said connecting duct between a first position, in which said connecting duct connects said venturi nozzle to said first storage means, a second position, in which said connecting duct does not connect to either of said storage means, and a third position, in which said connecting duct connects said venturi nozzle to said second storage means, whereby the air and ingredient mixture from said first and said second storage means can be selectively added to a water stream flowing through said shower spray device.

14. A shower spray device according to claim 13, wherein said first storage means includes a first reservoir, and wherein said second storage means includes a second reservoir.

15. A shower spray device according to claim 14, further comprising a shoulder extending around said central part and a reservoir insert including a cover having a surround which is positioned on said shoulder.

16. A shower spray device according to claim 15, further comprising:

first and second directing tubes extending downwards from said cover and into said first and second reservoirs, respectively, said directing tubes extending above said cover as funnels; and first and second caps corresponding to said first and second directing tubes, each cap covering its corresponding funnel and including an opening to the atmosphere and an inlet tube extending downwards from said opening.

17. A shower spray device according to claim 13, wherein said switching means includes an activating part rotatably positioned in said central part, said activating part including said connecting duct.

18. A shower spray device according to claim 13, wherein said shower spray device is configured as a hand-held spray device which can be connected to a flexible water hose.

19. A shower spray device according to claim 13, wherein said first and said second storage means includes a sponge-like ingredient carrier.

20. A shower spray device according to claim 13, further comprising an axial through-passage bore extending through said handle piece, said through-passage bore including a narrowed section.

21. A shower spray device according to claim 20, wherein said venturi nozzle includes said narrowed section and a first duct of said series of ducts, said venturi nozzle being directed towards said head part and merging into a conically outwardly widening outlet bore.

* * * * *